US011592240B2

(12) United States Patent
Machida et al.

(10) Patent No.: US 11,592,240 B2
(45) Date of Patent: Feb. 28, 2023

(54) LOOP-TYPE HEAT PIPE WITH VAPOR MOVING PATH IN LIQUID PIPE

(71) Applicant: SHINKO ELECTRIC INDUSTRIES CO., LTD., Nagano (JP)

(72) Inventors: Yoshihiro Machida, Nagano (JP); Nobuyuki Kurashima, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 167 days.

(21) Appl. No.: 16/885,394

(22) Filed: May 28, 2020

(65) Prior Publication Data

US 2020/0378686 A1 Dec. 3, 2020

(30) Foreign Application Priority Data

May 31, 2019 (JP) ..... JP2019-102791

(51) Int. Cl.
*F28D 15/00* (2006.01)
*F28D 15/02* (2006.01)
*F28D 15/04* (2006.01)

(52) U.S. Cl.
CPC ..... *F28D 15/0266* (2013.01); *F28D 15/046* (2013.01)

(58) Field of Classification Search
CPC .. F28D 15/0266; F28D 15/046; F28D 15/043; F28D 15/0233
See application file for complete search history.

(56) References Cited

U.S. PATENT DOCUMENTS 3,537,515 A * 11/1970 Byrd ..... H01J 45/00 310/306
4,862,321 A * 8/1989 Saitoo ..... H01L 23/427 257/722
7,748,436 B1 * 7/2010 Anderson ..... F28D 15/0266 165/104.21
2016/0259383 A1 9/2016 Shioga et al.
(Continued)

FOREIGN PATENT DOCUMENTS

CN 201463680 5/2010
JP 2015-183880 10/2015
(Continued)

OTHER PUBLICATIONS

European Search Report dated Oct. 19, 2020, 7 pages.
Japanese Office Action dated Oct. 25, 2022, English translation included, 10 pages.

*Primary Examiner* — Travis Ruby
(74) *Attorney, Agent, or Firm* — Rankin, Hill & Clark LLP

(57) ABSTRACT

A loop-type heat pipe includes an evaporator configured to vaporize an operating fluid, a condenser configured to condense the operating fluid, a liquid pipe configured to connect the evaporator and the condenser, a vapor pipe configured to connect the evaporator and the condenser, a porous body provided in the liquid pipe, and a vapor moving path provided at a part in the liquid pipe separately from the porous body and extending from the evaporator along a longitudinal direction of the liquid pipe, the operating fluid vaporized in the evaporator moving in the vapor moving path. The vapor moving path has a flow path in which the operating fluid vaporized in the evaporator flows and a wall part surrounding the flow path.

11 Claims, 12 Drawing Sheets

(56) References Cited

U.S. PATENT DOCUMENTS

| | | | | |
|---|---|---|---|---|
| 2018/0058767 | A1 | 3/2018 | Machida et al. | |
| 2018/0142960 | A1 | 5/2018 | Kurashima et al. | |
| 2019/0316848 | A1* | 10/2019 | Tseng | F28D 15/025 |

FOREIGN PATENT DOCUMENTS

| | | |
|---|---|---|
| JP | 6146484 | 5/2017 |
| JP | 2018-036012 | 3/2018 |

* cited by examiner

LOOP-TYPE HEAT PIPE WITH VAPOR MOVING PATH IN LIQUID PIPE

CROSS-REFERENCE TO RELATED APPLICATIONS

This application is based upon and claims the benefit of priority from prior Japanese patent application No. 2019-102791, filed on May 31, 2019, the entire contents of which are incorporated herein by reference.

TECHNICAL FIELD

The present disclosure relates to a loop-type heat pipe.

BACKGROUND ART

In the related art, as a device configured to cool a heat generation component of a semiconductor device (for example, a CPU and the like) mounted on an electronic device, a heat pipe configured to transport heat by using a phase change of an operating fluid is suggested (for example, refer to PTL 1).

The loop-type heat pipe includes an evaporation unit configured to receive heat from a heat generation body and to evaporate a liquid-phase operating fluid and a condensation unit configured to condense the vapor-phase operating fluid by heat radiation. Also, the loop-type heat pipe includes a vapor pipe for causing the operating fluid vaporized in the evaporation unit to flow into the condensation unit, and a liquid pipe for causing the operating fluid condensed in the condensation unit to flow into the evaporation unit. The loop-type heat pipe has a loop structure in which the evaporation unit, the vapor pipe, the condensation unit and the liquid pipe are connected in series, and the operating fluid is enclosed therein.

CITATION LIST

Patent Document

[PTL 1]

Japanese Patent No. 6,146,484

In the loop-type heat pipe of the related art, when a temperature around the loop-type heat pipe becomes lower than a freezing point of the operating fluid, the operating fluid is solidified. In this case, since the operating fluid is phase-transformed from liquid phase to solid phase, movement as a fluid cannot be implemented, so that a heat transport operation cannot be performed. As a result, it is not possible to cool the heat generation component.

SUMMARY OF INVENTION

Aspect of non-limiting embodiments of the present disclosure is to provide a loop-type heat pipe which can favorably cool the heat generation component A loop-type heat pipe comprises:

an evaporator configured to vaporize an operating fluid;

a condenser configured to condense the operating fluid;

a liquid pipe configured to connect the evaporator and the condenser;

a vapor pipe configured to connect the evaporator and the condenser;

a porous body provided in the liquid pipe; and a vapor moving path provided at a part in the liquid pipe separately from the porous body and extending from the evaporator along a longitudinal direction of the liquid pipe, the operating fluid vaporized in the evaporator moving in the vapor moving path, wherein the vapor moving path has a flow path in which the operating fluid vaporized in the evaporator flows and a wall part surrounding the flow path According to one aspect of the present disclosure, it is possible to favorably cool the heat generation component.

DESCRIPTION OF EMBODIMENTS

Figure 1:
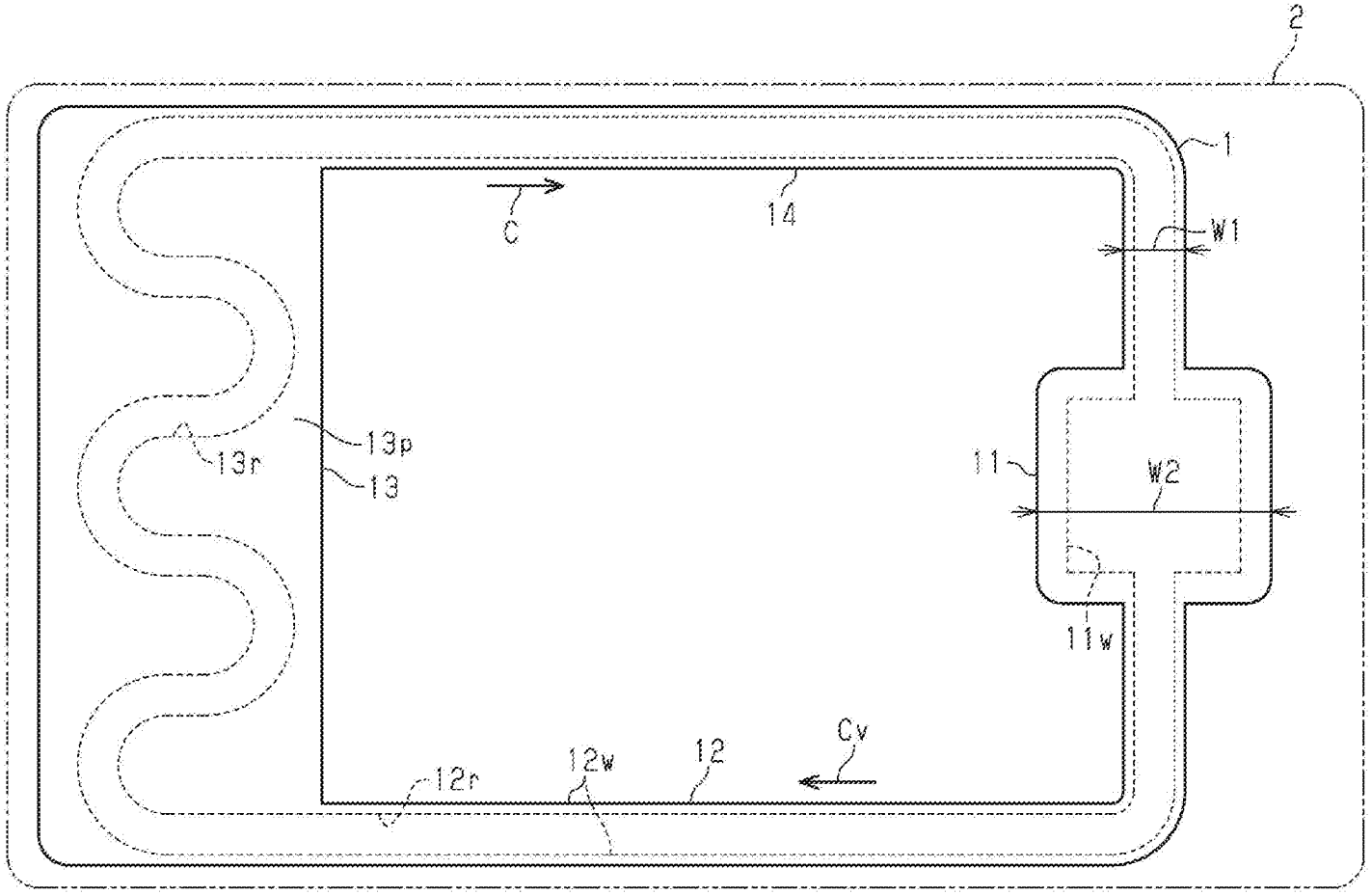
FIG. 1 is a pictorial plan view depicting a loop-type heat pipe in accordance with an embodiment.

Hereinbelow, embodiments will be described with reference to the accompanying drawings. In the meantime, for convenience, characteristic portions of the accompanying drawings may be shown in an enlarged manner for easy understanding of characteristics, and the dimensions and ratios of constitutional elements may be different in the respective drawings. Also, for easy understanding of the cross-sectional structure of each member, the hatching of some members is shown in a satin pattern and the hatching of some members is omitted in a cross-sectional view. In the meantime, as used herein, "as seen from above" indicates that a target object is seen in a vertical direction of FIG. 3 and the like (an upper and lower direction in the drawings), and "planar shape" indicates a shape as seen in the vertical direction of FIG. 3 and the like.

[Configuration]

A loop-type heat pipe 1 shown in FIG. 1 is accommodated in a mobile-type electronic device 2 such as a smart phone and a tablet terminal, for example. The loop-type heat pipe 1 includes an evaporator 11, a vapor pipe 12, a condenser 13, and a liquid pipe 14.

The evaporator 11 and the condenser 13 are connected by the vapor pipe 12 and the liquid pipe 14. The evaporator 11 has a function of vaporizing an operating fluid C to generate vapor Cv. The vapor Cv generated in the evaporator 11 is transported to the condenser 13 through the vapor pipe 12.

The condenser 13 has a function of condensing the vapor Cv of the operating fluid C. The condensed operating fluid C is transported to the evaporator 11 through the liquid pipe 14. The vapor pipe 12 and the liquid pipe 14 form a loop-shaped flow path through which the operating fluid C or the vapor Cv is caused to flow.

The vapor pipe 12 is formed as a long pipe body, for example. The liquid pipe 14 is formed as a long pipe body, for example. In the present embodiment, the vapor pipe 12 and the liquid pipe 14 have the same size (i.e., a size in the longitudinal direction), for example. On the other hand, the length of the vapor pipe 12 and the length of the liquid pipe 14 may be different from each other. For example, the length of the vapor pipe 12 may be shorter than the length of the liquid pipe 14. As used herein, the "longitudinal direction" of the evaporator 11, the vapor pipe 12, the condenser 13 and the liquid pipe 14 is a direction in which the operating fluid C or the vapor Cv flows in each member (refer to the arrow in the drawing).

The evaporator 11 is closely fixed to a heat generation component (not shown). The operating fluid C in the evaporator 11 is vaporized by heat generated in the heat generation component, so that the vapor Cv is generated. In the meantime, a thermal conductive member (TIM: Thermal Interface Material) may be interposed between the evaporator 11 and the heat generation component. The thermal conductive member reduces a contact thermal resistance between the heat generation component and the evaporator 11, thereby implementing smooth heat conduction from the heat generation component to the evaporator 11.

The vapor pipe 12 has a pair of pipe walls 12*w* provided on both sides in a width direction orthogonal to the longitudinal direction of the vapor pipe 12, as seen from above, and a flow path 12*r* provided between the pair of pipe walls 12*w*, for example. The flow path 12*r* is formed to communicate with an internal space of the evaporator 11. The flow path 12*r* is a part of the loop-shaped flow path. The vapor Cv generated in the evaporator 11 is guided to the condenser 13 through the vapor pipe 12.

The condenser 13 has a heat radiating plate 13*p* having a large area for heat radiation and a serpentine flow path 13*r* in the heat radiating plate 13*p*, for example. The flow path 13*r* is a part of the loop-shaped flow path. The vapor Cv guided through the vapor pipe 12 is condensed in the condenser 13. In this way, in the loop-type heat pipe 1, the heat generated in the heat generation component is transferred to the condenser 13 and is radiated in the condenser 13. Thereby, the heat generation component is cooled, so that an increase in temperature of the heat generation component is suppressed.

The operating fluid C condensed in the condenser 13 is guided to the evaporator 11 through the liquid pipe 14. Herein, a fluid having a high vapor pressure and a high evaporative latent heat is preferably used as the operating fluid C. Such operating fluid C is used, so that it is possible to effectively cool the heat generation component by the evaporative latent heat. As the operating fluid C, ammonia, water, Freon, alcohol, acetone and the like may be used, for example.

For example, a size W1 of the liquid pipe 14 in the width direction orthogonal to the longitudinal direction, as seen from above, is smaller than a size W2 of the evaporator 11 in the width direction orthogonal to the longitudinal direction, as seen from above.

Figure 2:
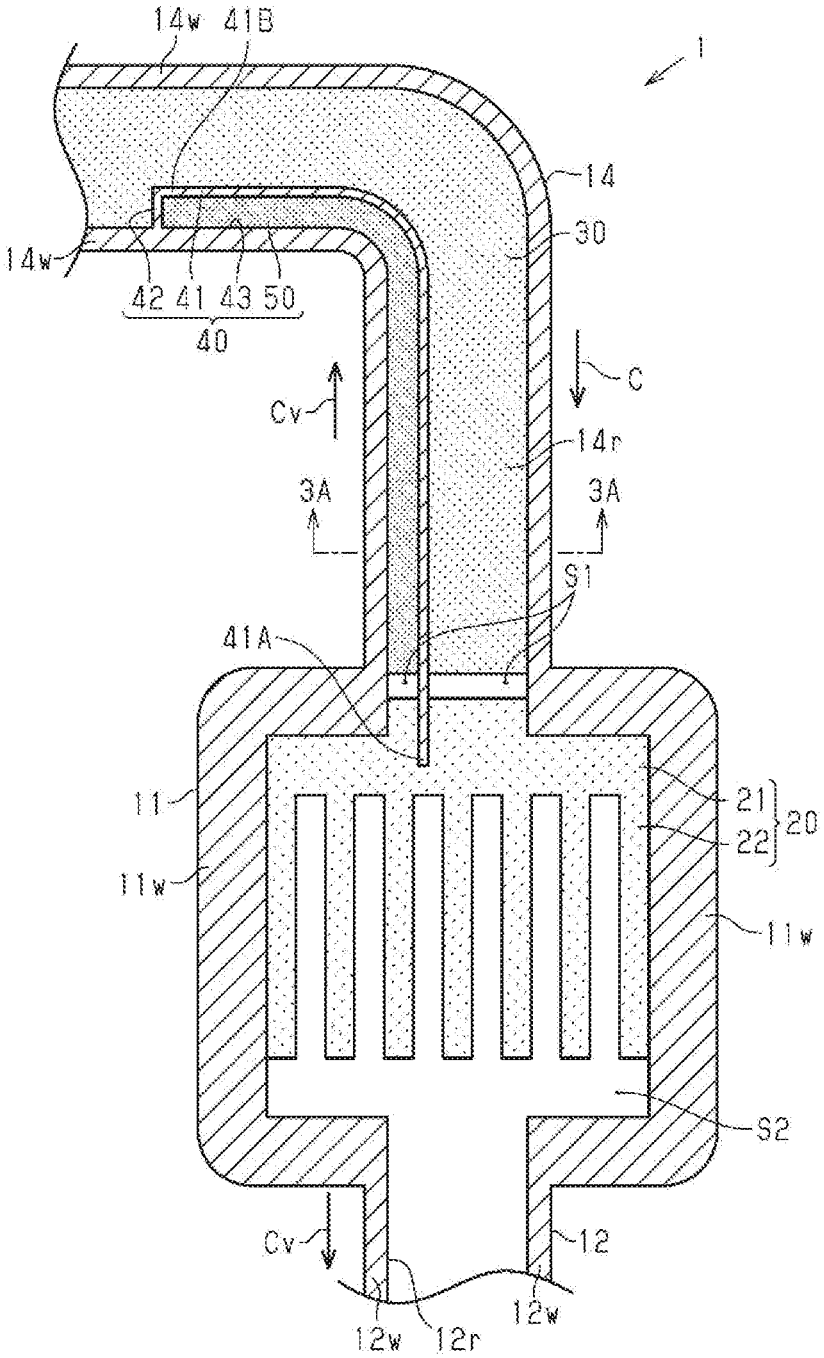
FIG. 2 is an enlarged plan view depicting a part of the loop-type heat pipe of the embodiment.

As shown in FIG. 2, the evaporator 11 is provided with a porous body 20. The porous body 20 has a connection part 21 and a plurality of protrusions 22. The connection part 21 is provided on a side in the internal space of the evaporator 11, which is the closest to the liquid pipe 14 (i.e., a side on which the liquid pipe 14 is connected to the evaporator 11), as seen from above, for example. The connection part 21 is formed to extend in the width direction (a right and left direction in FIG. 2) of the evaporator 11, for example. A surface of the connection part 21 on the liquid pipe 14-side is in partial contact with pipe walls 11*w* of the evaporator 11 and the remaining thereof is in contact with a space S1, for example. A surface of the connection part 21 on the vapor pipe 12-side is partially connected to the protrusions 22 and the remaining thereof is in contact with a space S2. Each of the protrusions 22 protrudes from the connection part 21 toward the vapor pipe 12, as seen from above, for example. Each of the protrusions 22 is formed to extend in the longitudinal direction of the evaporator 11, for example. The plurality of protrusions 22 is provided with predetermined intervals in the width direction of the evaporator 11, as seen from above, for example. An end portion of each of the protrusions 22 on the vapor pipe 12-side is spaced from the pipe walls 11*w* of the evaporator 11. The end portions of the respective protrusions 22 on the vapor pipe 12-side are not connected to each other. That is, the porous body 20 of the present embodiment is formed to have a comb shape having the connection part 21 and the plurality of protrusions 22, as seen from above. In the meantime, the number of the teeth of a comb of the porous body 20 can be changed as appropriate.

In the evaporator 11, an area in which the porous body 20 is not provided is formed with a space S2. The space S2 is connected to the flow path 12*r* of the vapor pipe 12.

The liquid pipe 14 has a pair of pipe walls 14*w* provided at both ends of the liquid pipe 14 in the width direction, and a porous body 30 and a vapor moving path 40 provided between the pair of pipe walls 14*w*.

The porous body 30 is formed to extend from the condenser 13 (refer to FIG. 1) to the vicinity of the evaporator 11 in the longitudinal direction of the liquid pipe 14, for example. The porous body 30 is configured to guide the operating fluid C condensed in the condenser 13 to the evaporator 11 by a capillary force that is generated in the porous body 30. The porous body 30 has a plurality of pores 62*z*, 63*z*, 64*z* and 65*z* (refer to FIG. 3), for example. The plurality of pores 62*z* to 65*z* functions as the flow path 14*r* through which the operating fluid C is to flow. The flow path 14*r* is a part of the loop-shaped flow path.

A surface of the porous body 30 on the evaporator 11-side is in contact with the space S1, for example. In the present embodiment, the space S1 is interposed between the porous body 30 of the liquid pipe 14 and the porous body 20 of the evaporator 11. On the other hand, the space S1 between the porous body 20 and the porous body 30 may be omitted. That is, the porous body 20 and the porous body 30 may be directly connected without the space S1.

The vapor moving path 40 is formed to extend from the evaporator 11 in the longitudinal direction of the liquid pipe 14. The vapor moving path 40 is formed to extend from the evaporator 11 to a point on the halfway in the longitudinal direction of the liquid pipe 14, along the longitudinal direction of the liquid pipe 14, for example. The vapor moving path 40 is provided in the vicinity of one pipe wall 14*w* of the pair of pipe walls 14*w*, for example. For example, the vapor moving path 40 is provided in the vicinity of the pipe wall 14*w*, which configures an inner side of a bent part of the liquid pipe 14, of the pair of pipe walls 14*w*. The vapor moving path 40 has, for example, a partitioning wall 41, a partitioning wall 42, a flow path 43, and a porous part 50.

The partitioning wall 41 is formed to extend from the internal space of the evaporator 11 to a point on the halfway in the longitudinal direction of the liquid pipe 14, along the longitudinal direction of the liquid pipe 14. An end portion 41A of the partitioning wall 41 on the evaporator 11-side is formed to protrude into the internal space of the evaporator 11, for example. The end portion 41A of the partitioning wall 41 is formed to protrude into the inside of the porous body 20 of the evaporator 11, for example. For example, the end portion 41A of the partitioning wall 41 is formed to protrude into the inside of the connection part 21 of the porous body 20. The partitioning wall 42 is formed to extend from an end portion 41B, which is on an opposite side to the end portion 41A of the partitioning wall 41 in the longitudinal direction, to the pipe wall 14*w* on one side (herein, a lower side in FIG. 2) along a width direction of the liquid pipe 14, for example. The partitioning wall 42 is formed to connect the end portion 41B of the partitioning wall 41 and the pipe wall 14*w*. The partitioning wall 42 configures one end portion of the vapor moving path 40 in the longitudinal direction. One end portion of the vapor moving path 40 in the longitudinal direction is closed by the partitioning wall 42 on the halfway of the liquid pipe 14 in the longitudinal direction. The partitioning walls 41 and 42 are formed to partition the flow path 43 of the vapor moving path 40 and the porous body 30 each other. The flow path 43 and the porous body 30 are completely separated by the partitioning walls 41 and 42. In other words, the flow path 43 is not communicated with the flow path 14*r* of the porous body 30.

The flow path 43 of the vapor moving path 40 is configured by a space surrounded by the partitioning wall 41, the partitioning wall 42 and the pipe wall 14*w*. The flow path 43 is formed to extend over an entire length of the vapor moving path 40 in the longitudinal direction. The flow path 43 is separated from the porous body 30 over the entire length of the vapor moving path 40 in the longitudinal direction by the partitioning walls 41 and 42. The partitioning walls 41 and 42 and the pipe wall 14*w* function as a wall part surrounding the flow path 43.

The flow path 43 is formed so that a cross-sectional area of a cross section obtained by cutting the vapor moving path 40 along a plane orthogonal to the longitudinal direction of the vapor moving path 40 is larger than a cross-sectional area of the flow path 14*r* of the porous body 30, for example. The cross-sectional area of the flow path 43 is formed smaller than a cross-sectional area of the flow path 12*r* of the vapor pipe 12, for example.

In the vapor moving path 40, the porous part 50 is provided, for example. The porous part 50 is formed to extend from the vicinity of the evaporator 11 to the partitioning wall 42 along the longitudinal direction of the vapor moving path 40, for example. The porous part 50 is configured to guide the operating fluid C condensed in the vapor moving path 40 to the evaporator 11 by a capillary force that is generated in the porous part 50, for example. The porous part 50 and the porous body 30 are completed separated by the partitioning walls 41 and 42 over the entire length of the vapor moving path 40 in the longitudinal direction.

A surface of the porous part 50 on the evaporator 11-side is in contact with the space S1, for example. In the present embodiment, the space S1 is interposed between the porous part 50 and the porous body 20 of the evaporator 11. On the other hand, the space S1 between the porous part 50 and the porous body 20 may be omitted. That is, the porous part 50 and the porous body 20 may be directly connected without the space S1.

In the meantime, in FIG. 2, in order to show planar shapes of the porous body 30 and porous part 50 in the liquid pipe 14 and the porous body 20 in the evaporator 11, a metal layer (for example, a metal layer 61 shown in FIG. 3) that is the outermost layer of a plurality of metal layers 61 to 66 (which will be described later) is not shown.

Figure 3:
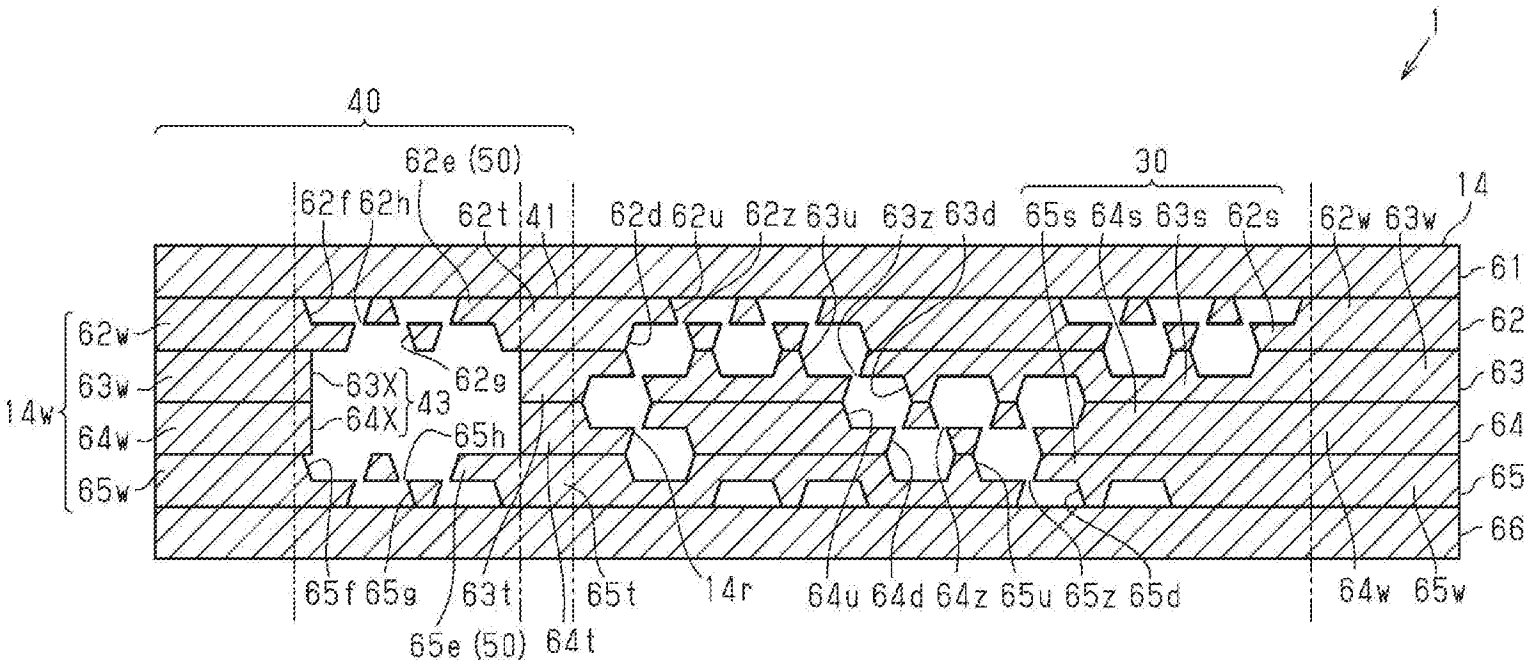
FIG. 3 is a schematic sectional view depicting a liquid pipe of the embodiment (a sectional view taken along a line 3A-3A in FIG. 2).

FIG. 3 is a cross-sectional view of the liquid pipe 14 taken along a line 3A-3A in FIG. 2. This cross section is orthogonal to a direction in which the operating fluid C flows in the liquid pipe 14 (a direction denoted with the arrow in FIG. 2).

As shown in FIG. 3, the liquid pipe 14 has a structure where six layers of metal layers 61 to 66 are stacked, for example. In other words, the liquid pipe 14 has a structure where the metal layers 62 to 65, which are intermediate metal layers, are stacked between the metal layers 61 and 66 that are a pair of outermost layers. The metal layers 61 to 66 are copper layers having high heat conductivity, for example, and are directly bonded to each other by solid-phase bonding (for example, diffusion bonding, press bonding and ultrasonic bonding) and the like. Meanwhile, in FIG. 3, the metal layers 61 to 66 are distinguished with solid lines for easy understanding. For example, when the metal layers 61 to 66 are integrated by diffusion bonding, interfaces between the respective metal layers 61 to 66 are lost, so that the interfaces may not be clear. As used herein, the solid-phase bonding is a method of heating and softening bonding targets in a solid state without melting the same, and then pressing, plastically deforming and bonding the bonding targets.

In the meantime, the metal layers 61 to 66 are not limited to the copper layers and may be formed of stainless steel, aluminum, magnesium alloy and the like. Also, for some of the stacked metal layers 61 to 66, a material different from the other metal layers may be used. A thickness of each of the metal layers 61 to 66 may be set to about 50 μm to 200 μm, for example. In the meantime, some of the metal layers 61 to 66 may be formed to have a thickness different from the other metal layers. Also, all the metal layers may be formed to have thicknesses different from each other.

The evaporator 11, the vapor pipe 12 and the condenser 13 shown in FIG. 1 are respectively formed by stacking six layers of the metal layers 61 to 66, like the liquid pipe 14 shown in FIG. 3. That is, the loop-type heat pipe 1 shown in FIG. 1 is configured by stacking six layers of the metal layers 61 to 66. In the meantime, the number of stacked metal layers is not limited to six, and may be five layers or less or seven layers or more.

As shown in FIG. 3, the liquid pipe 14 of the present embodiment consists of the stacked metal layers 61 to 66, and has the pipe walls 14*w*, the porous body 30 and the vapor moving path 40 (the partitioning walls 41 and 42, the flow path 43 and the porous part 50). In the meantime, in the present embodiment, the metal layers 61 and 66 of the metal layers 61 to 66 that are the outermost layers are not formed with a hole and a groove. The metal layers 61 and 66 function as a wall part (a top part or a bottom part) of the liquid pipe 14.

The metal layer 62 has a pair of wall parts 62*w* provided on both ends in a width direction (a right and left direction in FIG. 3) orthogonal to the stacking direction of the metal layers 61 to 66, and a wall part 62*t* provided between the pair of wall parts 62*w*. The metal layer 62 has a porous body 62*s* provided between the wall part 62*w* on one side (herein, a right side in FIG. 3) and the wall part 62*t* and a porous part 62*e* provided between the wall part 62*w* on the other side (herein, a left side in FIG. 3) and the wall part 62*t*.

The metal layer 63 has a pair of wall parts 63*w* provided on both ends in the width direction and a wall part 63*t* provided between the pair of wall parts 63*w*. The metal layer 63 has a porous body 63*s* provided between the wall part 63*w* on one side (herein, a right side in FIG. 3) and the wall part 63*t* and a through-hole 63X formed between the wall part 63*w* on the other side (herein, a left side in FIG. 3) and the wall part 63*t* and penetrating the metal layer 63 in a thickness direction.

The metal layer 64 has a pair of wall parts 64*w* provided on both ends in the width direction and a wall part 64*t* provided between the pair of wall parts 64*w*. The metal layer 64 has a porous body 64*s* provided between the wall part 64*w* on one side (herein, a right side in FIG. 3) and the wall part 64*t* and a through-hole 64X formed between the wall part 64*w* on the other side (herein, a left side in FIG. 3) and the wall part 63*t* and penetrating the metal layer 64 in the thickness direction.

The metal layer 65 has a pair of wall parts 65*w* provided on both ends in the width direction, and a wall part 65*t* provided between the pair of wall parts 65*w*. The metal layer 65 has a porous body 65*s* provided between the wall part 65*w* on one side (herein, a right side in FIG. 3) and the wall part 652*t* and a porous part 65*e* provided between the wall part 65*w* on the other side (herein, a left side in FIG. 3) and the wall part 65*t*.

Subsequently, a specific structure of each pipe wall 14*w* is described.

Each pipe wall 14*w* is configured by the wall parts 62*w* to 65*w* of the intermediate metal layers 62 to 65 of the metal layers 61 to 66. Each pipe wall 14*w* is configured by the plurality of sequentially stacked wall parts 62*w* to 65*w*. The wall parts 62*w* to 65*w* of the present embodiment are not formed with a hole and a groove.

Subsequently, a specific structure of the porous body 30 is described.

The porous body 30 is configured by the porous bodies 62*s* to 65*s* of the intermediate metal layers 62 to 65 of the metal layers 61 to 66. The porous body 30 is configured by the plurality of sequentially stacked porous bodies 62*s* to 65*s*.

The porous body 62*s* is formed with bottomed holes 62*u* recessed from an upper surface of the metal layer 62 to a substantially central part in the thickness direction and bottomed holes 62*d* recessed from a lower surface of the metal layer 62 to a substantially central part in the thickness direction. An inner wall of each of the bottomed holes 62*u* and 62*d* may have a tapered shape that becomes wider from a bottom side (a central part side of the metal layer 62 in the thickness direction) toward an opening side (upper and lower surfaces-side of the metal layer 62). In the meantime, the inner wall of each of the bottomed holes 62*u* and 62*d* may be formed to extend vertically with respect to the bottom, for example. Also, an inner wall surface of each of the bottomed holes 62*u* and 62*d* may be formed to have a concave shape of which a cross-sectional shape is a semi-circular or semi-elliptical shape (for example, refer to FIG. 8 and the like). As used herein, the "semicircular shape" includes a half circle obtained by bisecting a true circle, and circles of which arcs are longer or shorter than a half circle, for example. Also, as used herein, the "semi-elliptical shape" includes a semi-ellipse obtained by bisecting an ellipse, and ellipses of which arcs are longer or shorter than the semi-ellipse, for example. Also, the bottomed holes 62*u* and 62*d* may be formed into a shape in which the inner wall continues in an arc shape over the bottom.

Figure 4:
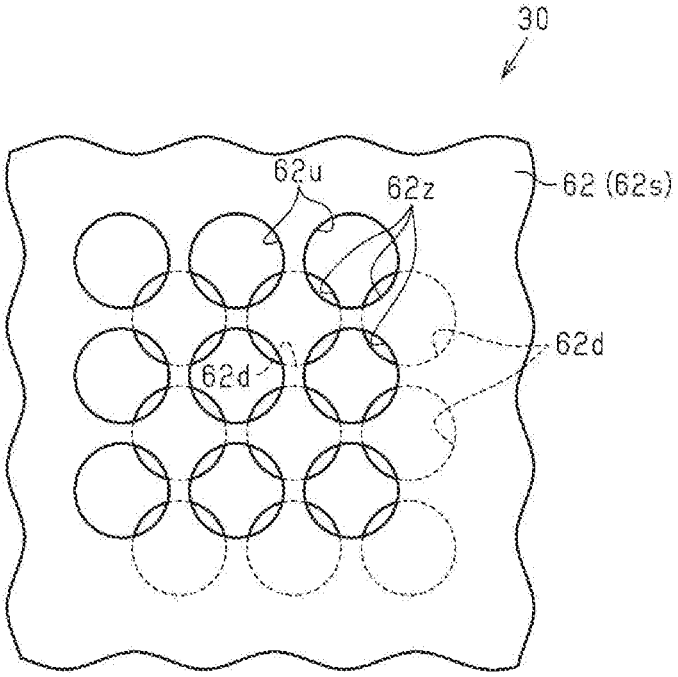
FIG. 4 is a schematic plan view illustrating a porous body of the embodiment.

As shown in FIG. 4, the bottomed holes 62*u* and 62*d* are respectively formed in a circular shape, as seen from above, for example. A diameter of each of the bottomed holes 62*u* and 62*d* may be set to about 100 μm to 400 μm, for example. In the meantime, the planar shape of each of the bottomed holes 62*u* and 62*d* may be any shape such as an elliptical shape, a polygonal shape and the like. The bottomed holes 62*u* and the bottomed holes 62*d* partially overlap, as seen from above. As shown in FIGS. 3 and 4, in portions in which the bottomed holes 62*u* and the bottomed holes 62*d* overlap as seen from above, the bottomed holes 62*u* and the bottomed holes 62*d* partially communicate with each other, thereby forming pores 62*z*. FIG. 4 illustrates an arrangement state of the bottomed holes 62*u* and 62*d*, the partial overlapping of the bottomed holes 62*u* and 62*d*, and the pores 62*z*. The porous body 62*s* having the bottomed holes 62*u* and 62*d* and the pores 62*z* configures a part of the porous body 30.

As shown in FIG. 3, the porous body 63*s* is formed with bottomed holes 63*u* recessed from an upper surface of the metal layer 63 to a substantially central part in the thickness direction and bottomed holes 63*d* recessed from a lower surface of the metal layer 63 to a substantially central part in the thickness direction. The bottomed holes 63*u* and 63*d* may have similar shapes to the bottomed holes 62*u* and 62*d* of the metal layer 62. The bottomed holes 63*u* and the bottomed holes 63*d* partially overlap, as seen from above. In portions in which the bottomed holes 63*u* and the bottomed holes 63*d* overlap as seen from above, the bottomed holes 63*u* and the bottomed holes 63*d* partially communicate with each other, thereby forming pores 63*z*. The porous body 63*s* having the bottomed holes 63*u* and 63*d* and the pores 63*z* configures a part of the porous body 30.

The bottomed holes 62*d* of the metal layer 62 and the bottomed holes 63*u* of the metal layer 63 are formed in overlapping positions, as seen from above, for example. For this reason, a pore is not formed at an interface between the bottomed hole 62*d* and the bottomed hole 63*u*.

The porous body 64*s* is formed with bottomed holes 64*u* recessed from an upper surface of the metal layer 64 to a substantially central part in the thickness direction and bottomed holes 64*d* recessed from a lower surface of the metal layer 64 to a substantially central part in the thickness direction. The bottomed holes 64*u* and 64*d* may have similar shapes to the bottomed holes 62*u* and 62*d* of the metal layer 62. The bottomed holes 64*u* and the bottomed holes 64*d* partially overlap, as seen from above. In portions in which the bottomed holes 64*u* and the bottomed holes 64*d* overlap as seen from above, the bottomed holes 64*u* and the bottomed holes 64*d* partially communicate with each other, thereby forming pores 64*z*. The porous body 64*s* having the bottomed holes 64*u* and 64*d* and the pores 64*z* configures a part of the porous body 30.

The bottomed holes 63*d* of the metal layer 63 and the bottomed holes 64*u* of the metal layer 64 are formed in overlapping positions, as seen from above, for example. For this reason, a pore is not formed at an interface between the bottomed hole 63*d* and the bottomed hole 64*u*.

The porous body 65*s* is formed with bottomed holes 65*u* recessed from an upper surface of the metal layer 65 to a substantially central part in the thickness direction and bottomed holes 65*d* recessed from a lower surface of the metal layer 65 to a substantially central part in the thickness direction. The bottomed holes 65*u* and 65*d* may have similar shapes to the bottomed holes 62*u* and 62*d* of the metal layer 62. The bottomed holes 65*u* and the bottomed holes 65*d* partially overlap, as seen from above. In portions in which the bottomed holes 65*u* and the bottomed holes 65*d* overlap as seen from above, the bottomed holes 65*u* and the bottomed holes 65*d* partially communicate with each other, thereby forming pores 65*z*. The porous body 65*s* having the bottomed holes 65*u* and 65*d* and the pores 65*z* configures a part of the porous body 30.

The bottomed holes 64*d* of the metal layer 64 and the bottomed holes 65*u* of the metal layer 65 are formed in overlapping positions, as seen from above, for example. For this reason, a pore is not formed at an interface between the bottomed hole 64*d* and the bottomed hole 65*u*.

The pores 62*z*, 63*z*, 64*z* and 65*z* formed in the respective metal layers 62 to 65 communicate with each other. The pores 62*z*, 63*z*, 64*z* and 65*z* that communicate with each other are spread three-dimensionally in the porous body 30. The operating fluid C is spread three-dimensionally in the pores 62*z* to 65*z* that communicate with each other by the capillary force. In this way, the pores 62*z* to 65*z* function as the flow path 14*r* in which the liquid-phase operating fluid C flows.

Subsequently, a specific structure of the vapor moving path 40 (the partitioning walls 41 and 42, the flow path 43 and the porous body 50) is described.

The partitioning wall 41 is configured by the wall parts 62*t* to 65*t* of the intermediate metal layers 62 to 65 of the metal layers 61 to 66. The partitioning wall 41 is configured by the plurality of sequentially stacked wall parts 62*t* to 65*t*. Although not shown, the partitioning wall 42 is configured by the wall parts 62*t* to 65*t* of the intermediate metal layers 62 to 65 of the metal layers 61 to 66, like the partitioning wall 41. The wall parts 62*t* to 65*t* of the present embodiment are not formed with a hole and a groove.

The flow path 43 is configured by the through-holes 63X and 64X penetrating the intermediate metal layers 63 and 64 of the stacked metal layers 61 to 66 in the thickness direction. The metal layer 63 and the metal layer 64 are stacked so that the through-holes 63X and 64X overlap each other.

The metal layer 62 is stacked on an upper surface of the metal layer 63, and the metal layer 65 is stacked on a lower surface of the metal layer 64. The flow path 43 is defined by the metal layers 62 to 65 and the through-holes 63X and 64X of the metal layers 63 and 64. The flow path 43 is surrounded by the wall parts 63*t* and 64*t* configuring parts of the partitioning walls 41 and 42, the wall parts 63*w* and 64*w* configuring parts of the pipe wall 14*w*, and the metal layers 62 and 65. In other words, the wall part 62*t*, 63*t*, 64*t* and 65*t*, the wall part 62*w*, 63*w*, 64*w* and 65*w*, and the metal layers 62 and 65 function as a wall part surrounding the flow path 43.

The porous part 50 is configured by the porous parts 62*e* and 65*e* of the metal layers 62 and 65. The porous part 62*e* is provided immediately above the flow path 43. The porous part 65*e* is provided immediately below the flow path 43.

The porous part 62*e* extends in the longitudinal direction of the flow path 43. The porous part 62*e* is formed in contact with the flow path 43. The porous part 62*e* is formed in the metal layer 62 that functions as a wall part surrounding the flow path 43. The porous part 62*e* is formed with bottomed holes 62*f* recessed from an upper surface of the metal layer 62 to a substantially central part in the thickness direction and bottomed holes 62*g* recessed from a lower surface of the metal layer 62 to a substantially central part in the thickness direction. The bottomed holes 62*f* and 62*g* each have a circular shape, as seen from above, like the bottomed holes 62*u* and 62*d* of the porous body 62*s*. The bottomed holes 62*f* and the bottomed holes 62*g* partially overlap, as seen from above. In portions in which the bottomed holes 62*f* and the bottomed holes 62*g* overlap as seen from above, the bottomed holes 62*f* and the bottomed holes 62*g* partially communicate with each other, thereby forming pores 62*h*. The bottomed holes 62*g* communicate with the flow path 43 (specifically, the through-hole 63X of the metal layer 63). The bottomed holes 62*f* and 62*g* and the pores 62*h* may have similar shapes to the bottomed holes 62*u* and 62*d* and the pores 62*z* of the porous body 62*s*.

The metal layer 65 has the porous part 65*e* formed immediately below the flow path 43. The porous part 65*e* extends in the longitudinal direction of the flow path 43. The porous part 65*e* is formed in contact with the flow path 43. The porous part 65*e* is formed in the metal layer 65 that functions as a wall part surrounding the flow path 43. The porous part 65*e* is formed with bottomed holes 65*f* recessed from an upper surface of the metal layer 65 to a substantially central part in the thickness direction and bottomed holes 65*g* recessed from a lower surface of the metal layer 65 to a substantially central part in the thickness direction. The bottomed holes 65*f* and 65*g* each have a circular shape, as seen from above, like the bottomed holes 62*u* and 62*d* of the porous body 62*s*. The bottomed holes 65*f* and the bottomed holes 65*g* partially overlap, as seen from above. In portions in which the bottomed holes 65*f* and the bottomed holes 65*g* overlap as seen from above, the bottomed holes 65*f* and the bottomed holes 65*g* partially communicate with each other, thereby forming pores 65*h*. The bottomed holes 65*f* communicate with the flow path 43 (specifically, the through-hole 64X of the metal layer 64). The bottomed holes 65*f* and 65*g* and the pores 65*h* may have similar shapes to the bottomed holes 62*u* and 62*d* and the pores 62*z* of the porous body 62*s*.

As described above, the vapor moving path 40 has the flow path 43. The flow path 43 is surrounded by the two porous parts 62*e* and 65*e*, the parts (the wall parts 63*t* and 64*t*) of the partitioning walls 41 and 42, and the parts (the wall parts 63*w* and 64*w*) of the pipe wall 14*w*. In the flow path 43, the operating fluid vaporized in the evaporator 11, i.e., the vapor Cv flows. As shown in FIG. 2, the vapor Cv moves in the flow path 43 from the evaporator 11 toward the partitioning wall 42 along the longitudinal direction of the flow path 43.

The liquid pipe 14 is provided with an inlet for injecting the operating fluid C (refer to FIG. 2), although not shown. However, the inlet is blocked by a seal member, so that an inside of the loop-type heat pipe 1 is air-tightly maintained. Also, although not shown, the porous body 20 provided in the evaporator 11 has a similar structure to the porous body 30 shown in FIGS. 3 and 4.

(Operations)

Subsequently, operations of the loop-type heat pipe 1 are described.

The loop-type heat pipe 1 includes the evaporator 11 configured to vaporize the operating fluid C, the condenser 13 configured to condense the vapor Cv, the vapor pipe 12 for causing the vaporized operating fluid (i.e., the vapor Cv) to flow into the condenser 13, and the liquid pipe 14 for causing the condensed operating fluid C to flow into the evaporator 11.

The liquid pipe 14 is provided with the porous body 30. The porous body 30 extends from the condenser 13 to the vicinity of the evaporator 11 along the longitudinal direction of the liquid pipe 14. The porous body 30 is configured to guide the liquid-phase operating fluid C condensed in the condenser 13 to the evaporator 11 by the capillary force that is generated in the porous body 30.

In the evaporator 11, the liquid-phase operating fluid C is introduced into the porous body 20 (the connection part 21 and the like), which is adjacent to the liquid pipe 20, of the porous body 20. In the evaporator 11, the liquid-phase operating fluid C is vaporized by the heat generated in the heat generation component (not shown), so that the vapor Cv is generated. The generated vapor Cv flows into the flow path 12*r* of the vapor pipe 12 and also flows into the flow path 43 of the vapor moving path 40 provided in the liquid pipe 14. The cross-sectional area of the flow path 43 is formed smaller than the cross-sectional area of the flow path 12*r* of the vapor pipe 12. For this reason, most of the vapor Cv generated in the evaporator 11 flows into the flow path 12*r* of the vapor pipe 12, and only a part of the vapor Cv generated in the evaporator 11 flows into the flow path 43 of the vapor moving path 40.

In the flow path 43, the vapor Cv generated in the evaporator 11 moves from the evaporator 11 toward the partitioning wall 42 along the longitudinal direction of the flow path 43. The vapor Cv moves in the flow path 43 in this way, so that the operating fluid C introduced into the porous body 30 of the liquid pipe 14 can be warmed by the evaporative latent heat (latent heat of vaporization) of the vapor Cv. Thereby, for example, even when the electronic device 2 including the loop-type heat pipe 1 is used in environments in which an ambient temperature is lower than the freezing point of the operating fluid C, such as cold regions and winter, it is possible to favorably suppress the liquid-phase operating fluid C in the liquid pipe 14 from being phase-transformed into solid phase.

Herein, when the vapor Cv flows in the flow path 43, the vapor Cv may be condensed in the flow path 43, in some cases. When the condensed operating fluid C stays in the flow path 43, the operating fluid C may be phase-transformed into solid phase. However, the vapor moving path 40 of the present embodiment is provided with the porous part 50. The porous part 50 extends from the partitioning wall 42, which is an end portion of the vapor moving path 40 in the longitudinal direction, to the vicinity of the evaporator 11 along the longitudinal direction of the vapor moving path 40. The porous part 50 guides the liquid-phase operating fluid C condensed in the flow path 43 to the evaporator 11 by the capillary force that is generated in the porous part 50. Thereby, even when the vapor Cv is condensed in the flow path 43, the condensed operating fluid C can be caused to flow back toward the evaporator 11, so that the condensed operating fluid C can be suppressed from staying in the flow path 43. As a result, it is possible to favorably suppress the operating fluid C in the flow path 43 from being phase-transformed into solid phase.

Subsequently, a manufacturing method of the loop-type heat pipe 1 is described.

Figures 5A, 5B, 5C, 5D, 5E:
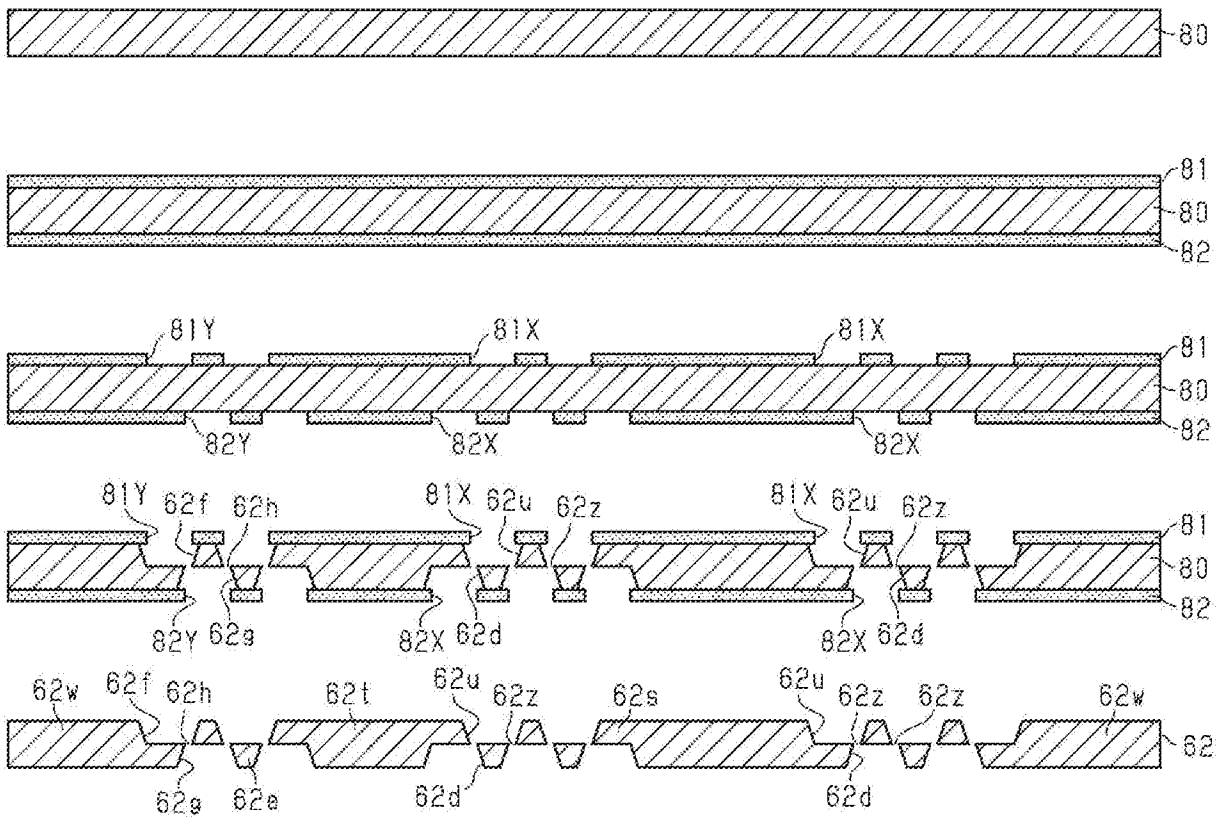
FIGS. 5A to 5E are schematic sectional views depicting a manufacturing method of the loop-type heat pipe of the embodiment.

First, in a process shown in FIG. 5A, a metal sheet 80 having a flat plate shape is prepared. The metal sheet 80 is a member that is to eventually become the metal layer 62 (refer to FIG. 3). The metal sheet 80 is formed of copper, stainless steel, aluminum, magnesium alloy or the like, for example. A thickness of the metal sheet 80 may be set to about 50 μm to 200 μm, for example.

Then, in a process shown in FIG. 5B, a resist layer 81 is formed on an upper surface of the metal sheet 80, and a resist layer 82 is formed on a lower surface of the metal sheet 80. For the resist layers 81 and 82, a photosensitive dry film resist or the like may be used, for example.

Subsequently, in a process shown in FIG. 5C, the resist layer 81 is exposed and developed to form opening portions 81X and 81Y for selectively exposing the upper surface of the metal sheet 80. Likewise, the resist layer 82 is exposed and developed to form opening portions 82X and 82Y for selectively exposing the lower surface of the metal sheet 80. The opening portions 81X and 82X are formed to correspond to shapes and positions of the bottomed holes 62*u* and 62*d* shown in FIG. 3. The opening portions 81Y and 82Y are formed to correspond to shapes and positions of the bottomed holes 62*f* and 62*g* shown in FIG. 3. In the meantime, parts of the metal sheet 80 corresponding to the wall parts 62*w* and 62*t* (refer to FIG. 3) are covered with the resist layers 81 and 82.

Subsequently, in a process shown in FIG. 5D, the metal sheet 80 exposed in the opening portions 81X and 81Y is etched from the upper surface-side of the metal sheet 80, and the metal sheet 80 exposed in the opening portions 82X and 82Y is etched from the lower surface-side of the metal sheet 80. The bottomed holes 62*u* are formed on the upper surface-side of the metal sheet 80 by the opening portions 81X, and the bottomed holes 62*d* are formed on the lower surface-side of the metal sheet 80 by the opening portions 82X. The bottomed holes 62*u* and the bottomed holes 62*d* are formed to partially overlap, as seen from above, and in the overlapping portions, the bottomed holes 62*u* and the bottomed holes 62*d* communicate with each other, so that the pores 62*z* are formed. Also, the bottomed holes 62*f* are formed on the upper surface-side of the metal sheet 80 by the opening portions 81Y, and the bottomed holes 62*g* are formed on the lower surface-side of the metal sheet 80 by the opening portions 82Y. The bottomed holes 62*f* and the bottomed holes 62*g* are formed to partially overlap, as seen from above, and in the overlapping portions, the bottomed holes 62*f* and the bottomed holes 62*g* communicate with each other, so that the pores 62*h* are formed. When etching the metal sheet 80, a ferric chloride solution may be used, for example.

Subsequently, the resist layers 81 and 82 are removed by a removing solution. Thereby, as shown in FIG. 5E, the metal layer 62 having the pair of wall parts 62*w*, the wall part 62*t*, the porous body 62*s* and the porous part 62*e* can be formed.

Figure 6A:
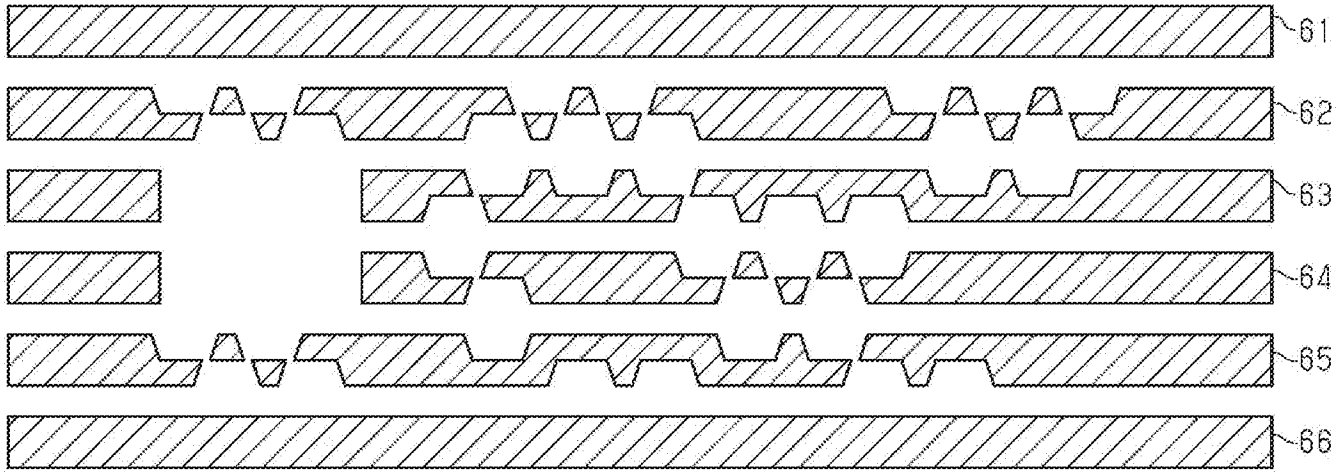
FIGS. 6A and 6B are schematic sectional views depicting the manufacturing method of the loop-type heat pipe of the embodiment.

Subsequently, in a process shown in FIG. 6A, solid metal layers 61 and 66 having no holes and grooves are prepared. Also, by a similar method to the processes shown in FIGS. 5A to 5E, the metal layers 63, 64 and 65 are formed. In the meantime, shapes and positions of the bottomed holes, the pores and the through-holes formed in the metal layers 63, 64 and 65 are as shown in FIG. 3, for example.

Figure 6B:
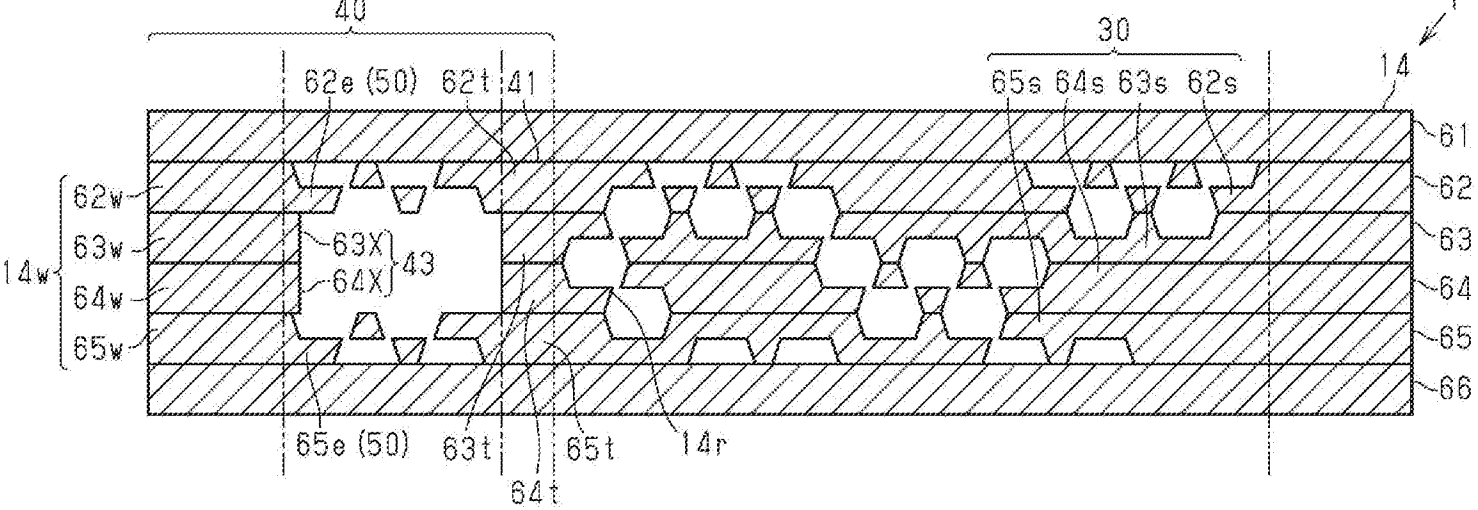

Subsequently, in a process shown in FIG. 6B, the metal layers 62, 63, 64, 65 and 66 are stacked in order below the metal layer 61, and are then pressurized and heated for solid-phase bonding. For example, the metal layers 61, 62, 63, 64, 65 and 66 stacked while heating the same at a predetermined temperature (for example, about 900° C.) are pressed, so that the metal layers 61, 62, 63, 64, 65 and 66 are bonded by solid-phase bonding. Thereby, the metal layers 61, 62, 63, 64, 65 and 66 adjacent to each other are directly bonded, so that the loop-type heat pipe 1 including the evaporator 11, the condenser 13, the vapor pipe 12 and the liquid pipe 14 shown in FIG. 1 is formed. Also, the liquid pipe 14 is formed with the porous body 30 and the vapor moving path 40, and the evaporator 11 is formed with the porous body 20.

Thereafter, the liquid pipe 14 is exhausted by using a vacuum pump and the like, and the operating fluid C is injected from the inlet (not shown) into the liquid pipe 14. Thereafter, the inlet is sealed.

In the below, effects of the present embodiment are described.

(1) The liquid pipe 14 is provided with the porous body 30, and the vapor moving path 40. The vapor moving path 40 is provided in a part of the liquid pipe 14 separately from the porous body 30 and extending from the evaporator 11 along the longitudinal direction of the liquid pipe 14, wherein the operating fluid (i.e., the vapor Cv) vaporized in the evaporator 11 moves in the vapor moving path 40. The vapor Cv moves in the vapor moving path 40, so that the operating fluid C introduced into the porous body 30 of the liquid pipe 14 can be warmed by the evaporative latent heat (latent heat of vaporization) of the vapor Cv. Thereby, for example, even when the electronic device 2 including the loop-type heat pipe 1 is used in environments in which an ambient temperature is lower than the freezing point of the operating fluid C, such as cold regions and winter, it is possible to favorably suppress the liquid-phase operating fluid C in the liquid pipe 14 from being phase-transformed into solid phase. For this reason, it is possible to favorably perform heat transport in the loop-type heat pipe 1 by using phase transform of the operating fluid C. As a result, even when the electronic device 2 is used in cold regions and the like, the heat generation component can be favorably cooled.

(2) The vapor moving path 40 is provided with the porous part 50. The porous part 50 extends from the partitioning wall 42, which is an end portion of the vapor moving path 40 in the longitudinal direction, to the vicinity of the evaporator 11 along the longitudinal direction of the vapor moving path 40. The porous part 50 guides the liquid-phase operating fluid C condensed in the flow path 43 to the evaporator 11 by the capillary force that is generated in the porous part 50. Thereby, even when the vapor Cv is condensed in the flow path 43, the condensed operating fluid C can be caused to flow back toward the evaporator 11, so that the condensed operating fluid C can be suppressed from staying in the flow path 43. As a result, it is possible to favorably suppress the operating fluid C in the flow path 43 from being phase-transformed into solid phase.

(3) The porous part 50 is formed in the wall part (herein, the metal layers 62 and 65) except the partitioning walls 41 and 42 partitioning the flow path 43 and the porous body of the wall part (herein, the partitioning walls 41 and 42, the pipe walls 14*w* and the metal layers 62 and 65) surrounding the flow path 43. Thereby, the porous part 50 is not interposed between the flow path 43 through which the vapor Cv moves and the porous body 30. For this reason, it is possible to favorably warm the operating fluid C introduced into the porous body 30 by the evaporative latent heat of the vapor Cv that moves in the flow path 43. Also, the flow path 43 of the vapor moving path 40 and the flow path 14*r* of the porous body are completely separated by the partitioning walls 41 and 42, so that the vapor Cv moving in the flow path 43 can be enabled not to flow into the porous body 30. For this reason, it is possible to favorably maintain the flowing of the operating fluid C in the flow path 14*r*.

(4) The partitioning wall 41 of the wall part surrounding the flow path 43 is formed to protrude into the internal space of the evaporator 11. According to this configuration, it is possible to favorably partition the area, in which the porous body 30 is formed, of the liquid pipe 14 and the flow path 43 of the vapor moving path 40 each other. Thereby, for example, it is possible to favorably suppress the liquid-phase operating fluid C guided to the evaporator 11 by the porous body 30 from flowing into the vapor moving path 40, as it is liquid phase.

(5) The partitioning wall 41 of the wall part surrounding the flow path 43 is formed to protrude into the inside of the connection part 21 of the porous body 20 provided in the evaporator 11. According to this configuration, the porous body 20 facing the flow path 43 and the porous body 20 facing the porous body 30 are partitioned each other by the partitioning wall 41. Thereby, the liquid-phase operating fluid C guided to the evaporator 11 by the porous body 30 can be favorably suppressed from being vaporized and flowing into the flow path 43 before it is introduced into the entire connection part 21. As a result, it is possible to favorably suppress the vapor Cv generated in the evaporator 11 from mainly flowing into the flow path 43.

(6) The wall part surrounding the flow path 43 includes the pipe walls 14*w* of the liquid pipe 14 and the partitioning walls 41 and 42. That is, the pipe walls 14*w* of the liquid pipe 14 are used as the wall part surrounding the flow path 43. Thereby, as compared to a configuration in which the wall part surrounding the flow path 43 is formed without using the pipe walls 14*w*, it is possible to secure a wider space in which the operating fluid C condensed in the condenser 13 flows (i.e., the space in which the porous body 30 is formed).

(7) The cross-sectional area of the flow path 43 of the vapor moving path 40 is formed greater than the cross-sectional area of the flow path 14*r* of the porous body 30, and smaller than the cross-sectional area of the flow path 12*r* of the vapor pipe 12. Thereby, while most of the vapor Cv generated in the evaporator 11 can be caused to flow into the flow path 12*r* of the vapor pipe 12, a part of the vapor Cv generated in the evaporator 11 can be caused to flow into the flow path 43 of the vapor moving path 40.

Other Embodiments

The above embodiment can be changed and implemented, as follows. The above embodiment and following embodiments can be combined with each other without technology inconsistency.

In the below, each modified embodiment of the liquid pipe 14 is described. In the meantime, in each modified embodiment, the same constitutional elements as the above embodiment and the same constitutional elements among the respective modified embodiments are denoted with the same reference signs, and the descriptions thereof may be partially or entirely omitted. In the meantime, since the parts other than the liquid pipe are the same as the above embodiment (refer to FIG. 1), the drawings and descriptions are omitted while referring to FIG. 1 and the like In the vapor moving path 40 of the above embodiment, the wall part, which faces in the stacking direction of the metal layers 61 to 66, of the wall part surrounding the flow path 43, i.e., the metal layers 62 and 65 are provided with the porous part 50 (the porous parts 62*e* and 65*e*). The present disclosure is not limited thereto. For example, only one of the metal layers 62 and 65 may be provided with the porous part 50. Also, the pipe walls 14*w* (the wall parts 62*w* to 65*w*) or the partitioning walls 41 and 42 (the wall parts 62*t* to 65*t*) of the wall part surrounding the flow path 43 may be provided with the porous part 50. In this case, for example, a part of the wall parts 62*w* to 65*w* configuring the pipe wall 14*w* may be provided with the porous part 50 integrally and continuously from the wall parts 62*w* to 65*w*. Also, a part of the wall parts 62*t* to 65*t* configuring the partitioning walls 41 and 42 may be provided with the porous part 50 integrally and continuously from the wall parts 62*t* to 65*t*. In any case, the porous part 50 is formed in contact with the flow path 43.

In the vapor moving path 40 of the above embodiment, the wall part surrounding the flow path 43 is provided with the porous part 50. However, the present disclosure is not limited thereto. For example, the wall part surrounding the flow path 43 may be formed with a groove portion, instead of the porous part 50. A shape of the groove portion is not particularly limited inasmuch as it can guide the operating fluid C condensed in the flow path 43 to the evaporator 11 by a capillary force that is generated in the groove portion.

Figure 7:
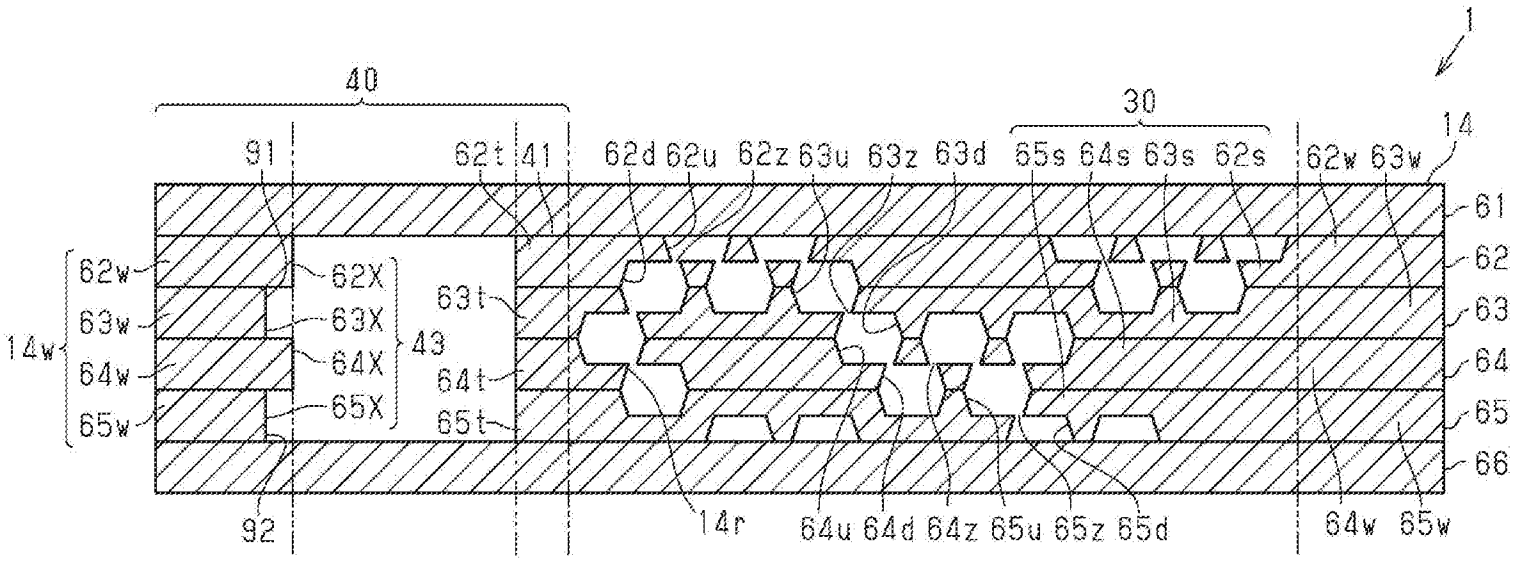
FIG. 7 is a schematic sectional view depicting a liquid pipe of a modified embodiment.

For example, as shown in FIG. 7, in the vapor moving path 40, the pipe wall 14*w* of the liquid pipe 14 may be formed with groove portions 91 and 92. A side surface, which is in contact with the flow path 43, of side surfaces of the pipe wall 14*w* is formed with linear groove portions 91 and 92 extending in the longitudinal direction of the vapor moving path 40. The groove portions 91 and 92 are formed by changing widths of the wall parts 62*w* to 65*w* configuring the pipe wall 14*w*, for example. In the modified embodiment of FIG. 7, widths of the wall parts 63*w* and 65*w* of the wall parts 62*w* to 65*w* are made smaller than widths of the wall parts 62*w* and 64*w*, so that the groove portions 91 and 92 are formed. The groove portion 91 is configured by a step formed by a side surface of the wall part 62*w*, a side surface of the wall part 63*w* and a side surface of the wall part 64*w*. The groove portion 92 is configured by a step formed by a side surface of the wall part 64*w* and a side surface of the wall part 65*w*. The groove portions 91 and 92 are formed to communicate with the flow path 43. The groove portions 91 and 92 can guide the operating fluid C condensed in the flow path 43 to the evaporator 11 (refer to FIG. 2) by a capillary force that is generated in the groove portions 91 and 92.

Meanwhile, in this modified embodiment, the porous parts 62*e* and 65*e* (porous part 50) of the metal layers 62 and 65 shown in FIG. 3 are omitted. In this case, the flow path 43 is surrounded by the wall parts 62*w* to 65*w* configuring the pipe wall 14*w*, the wall parts 62*t* to 65*t* configuring the partitioning walls 41 and 42, and the metal layers 61 and 66. In this modified embodiment, the flow path 43 is configured by through-holes 62X, 63X, 64X and 65X penetrating the intermediate metal layers 62 to 65 of the stacked metal layers 61 to 66 in the thickness direction. The metal layers 62 to 65 are stacked so that the respective through-holes 62X, 63X, 64X and 65X overlap each other.

Figure 8:
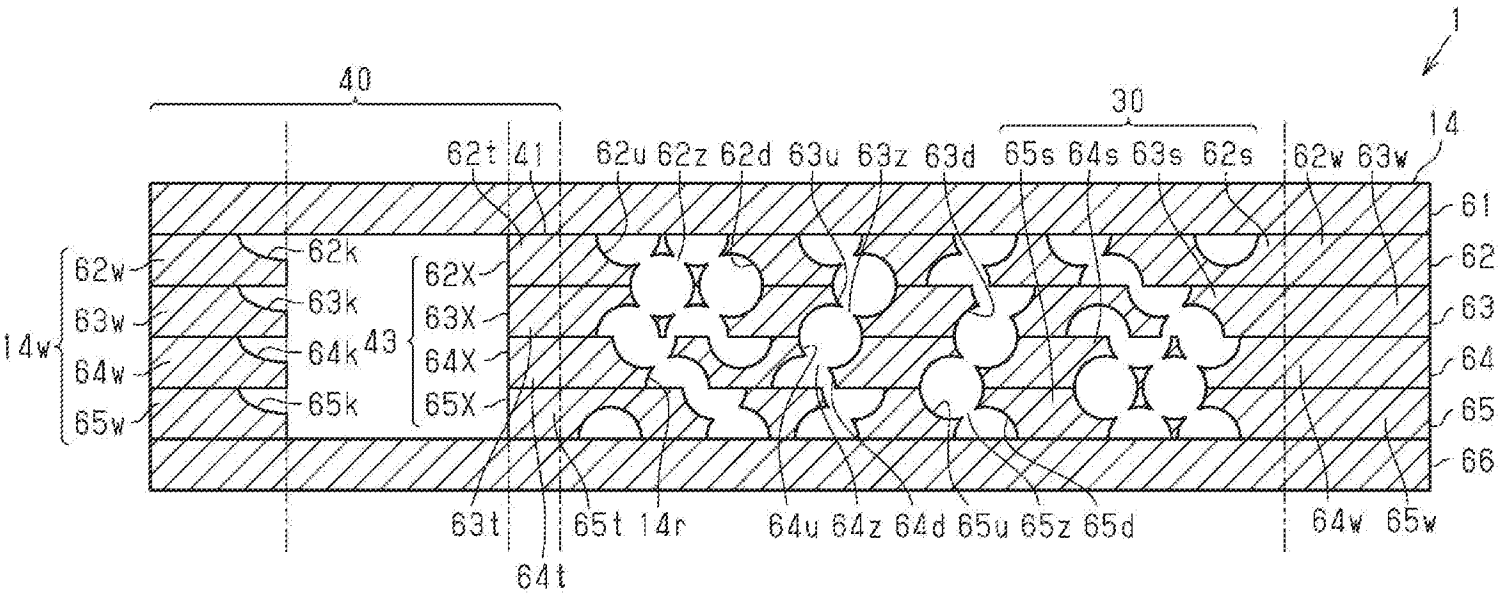
FIG. 8 is a schematic sectional view depicting a liquid pipe of a modified embodiment.

For example, in the liquid pipe 14 of FIG. 8, groove portions formed in a side surface of the pipe wall 14*w* are different from FIG. 7. A side surface, which is in contact with the flow path 43, of the side surfaces of the pipe wall 14*w* is formed with linear groove portions 62*k* to 65*k* extending in the longitudinal direction of the vapor moving path 40. The groove portions 62*k* to 65*k* each have an arc-shaped section. The groove portions 62*k* to 65*k* are formed recessed from the upper surfaces of the wall parts 62*w* to 65*w* configuring the pipe wall 14*w* to a central part in the thickness direction, for example. For example, the groove portions 62*k* to 65*k* are formed by half etching the wall parts 62*w* to 65*w* from the upper surfaces thereof. The groove portions 62*k* to 65*k* are formed to communicate with the flow path 43. The groove portions 62*k* to 65*k* can guide the operating fluid C condensed in the flow path 43 to the evaporator 11 by a capillary force that is generated in the groove portions 62*k* to 65*k*.

Figure 9:
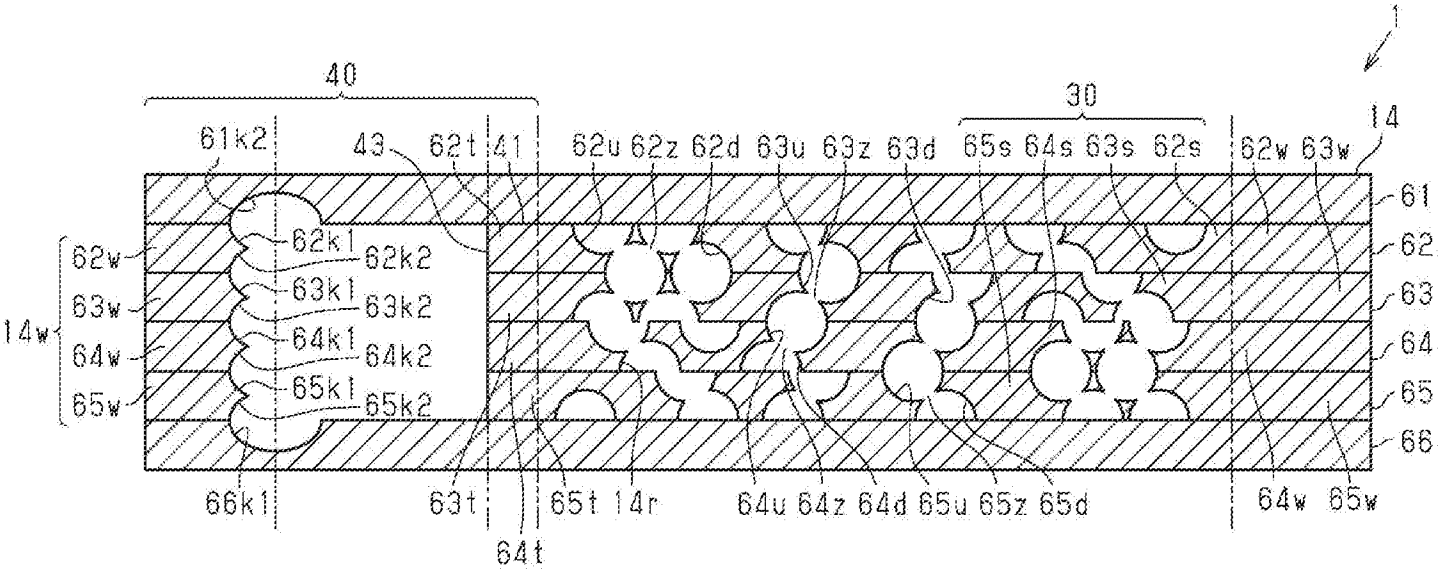
FIG. 9 is a schematic sectional view depicting a liquid pipe of a modified embodiment.

For example, in the liquid pipe 14 of FIG. 9, groove portions formed in a side surface of the pipe wall 14*w* are different from FIG. 8, and the metal layers 61 and 66 are formed with groove portions. A side surface, which is in contact with the flow path 43, of the side surfaces of the pipe wall 14*w* is formed with linear groove portions 61*k*2, 62*k*1, 62*k*2, 63*k*1, 63*k*2, 64*k*1, 64*k*2, 65*k*1, 65*k*2 and 66*k*1 extending in the longitudinal direction of the vapor moving path 40.

The groove portion 62*k*1 is formed by half etching the wall part 62*w* configuring the pipe wall 14*w* from the upper surface-side thereof, for example. The groove portion 62*k*2 is formed by half etching the wall part 62*w* configuring the pipe wall 14*w* from the lower surface-side thereof, for example. The groove portion 63*k*1 is formed by half etching the wall part 63*w* configuring the pipe wall 14*w* from the upper surface-side thereof, for example. The groove portion 63*k*2 is formed by half etching the wall part 63*w* configuring the pipe wall 14*w* from the lower surface-side thereof, for example. The groove portion 64*k*1 is formed by half etching the wall part 64*w* configuring the pipe wall 14*w* from the upper surface-side thereof, for example. The groove portion 64*k*2 is formed by half etching the wall part 64*w* configuring the pipe wall 14*w* from the lower surface-side thereof, for example. The groove portion 65*k*1 is formed by half etching the wall part 65*w* configuring the pipe wall 14*w* from the upper surface-side thereof, for example. The groove portion 65*k*2 is formed by half etching the wall part 65*w* configuring the pipe wall 14*w* from the lower surface-side thereof, for example. The groove portion 61*k*2 is formed by half etching the outermost metal layer 61 from the lower surface-side, for example. The groove portion 66*k*1 is formed by half etching the outermost metal layer 66 from the upper surface-side, for example. The groove portions 61*k*2, 62*k*1, 62*k*2, 63*k*1, 63*k*2, 64*k*1, 64*k*2, 65*k*1, 65*k*2 and 66*k*1 are formed to have an arc-shaped section, for example. The groove portions 61*k*2, 62*k*1, 62*k*2, 63*k*1, 63*k*2, 64*k*1, 64*k*2, 65*k*1, 65*k*2 and 66*k*1 are formed to communicate with the flow path 43. The groove portions 61*k*2, 62*k*1, 62*k*2, 63*k*1, 63*k*2, 64*k*1, 64*k*2, 65*k*1, 65*k*2 and 66*kl* can guide the operating fluid C condensed in the flow path 43 to the evaporator 11 by a capillary force that is generated in the groove portions.

In the modified embodiments of FIGS. 7 to 9, the side surface of the pipe wall 14*w* is formed with the groove portions. However, the side surfaces of the partitioning walls 41 and 42 may be formed with the groove portions. Also, the groove portion may be formed in the lower surface of the metal layer 61 or on the upper surface of the metal layer 66.

In the modified embodiments of FIGS. 7 to 9, the porous parts 62*e* and 65*e* (porous part 50) of the metal layers 62 and 65 shown in FIG. 3 may be formed.

In the above embodiment, the structure other than the vapor moving path 40 of the liquid pipe 14 is not particularly limited inasmuch as it can guide the operating fluid C condensed in the condenser 13 to the evaporator 11. For example, apart of the liquid pipe 14 other than the vapor moving path 40 may be formed with a space in which the porous body is not formed. This space functions as a flow path in which the operating fluid C condensed in the condenser 13 flows.

Figure 10:
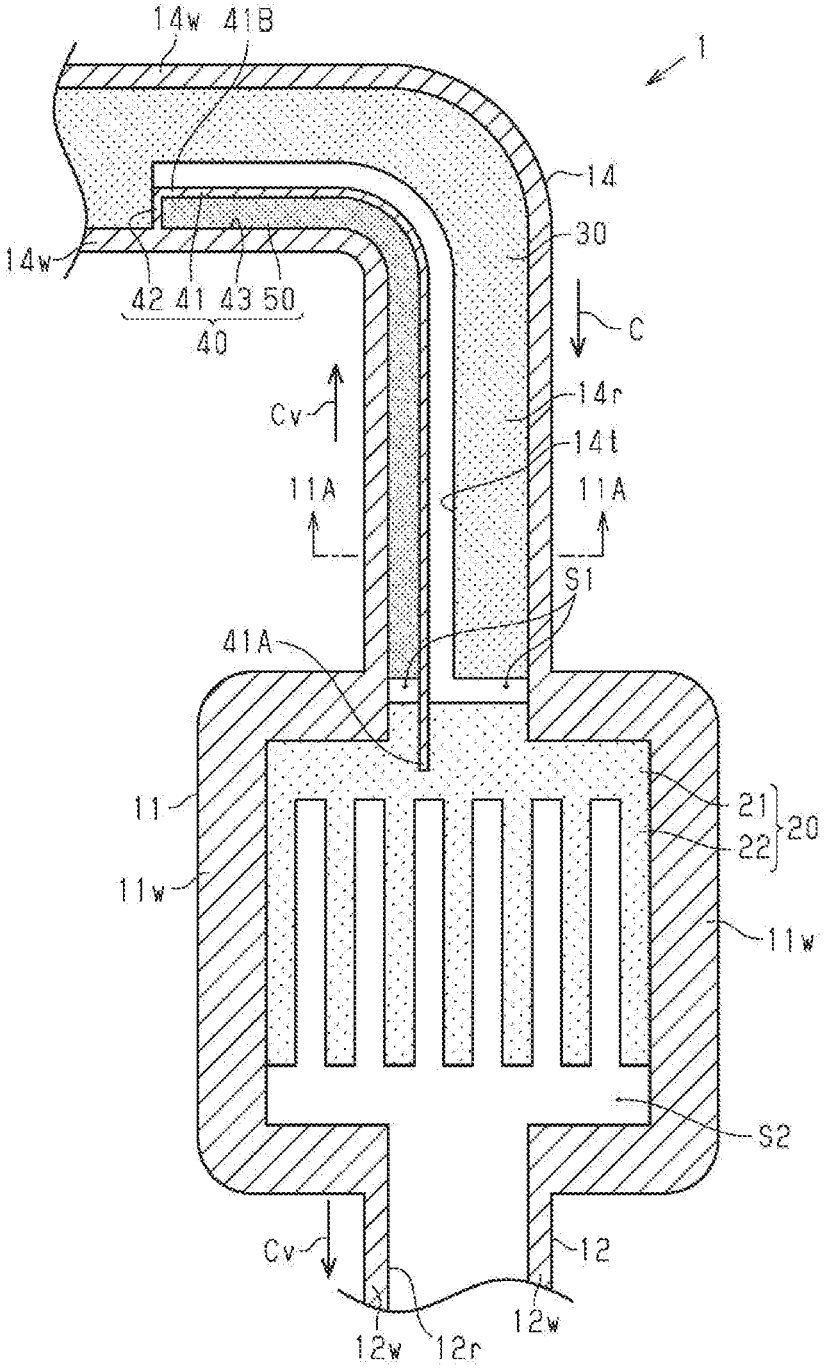
FIG. 10 is a schematic plan view depicting a loop-type heat pipe of a modified embodiment.

For example, as shown in FIG. 10, a space in which the porous body 30 is not formed, i.e., a flow path 14*t* in which the operating fluid C condensed in the condenser 13 flows may be formed between the vapor moving path 40 and the porous body 30, adjacent to the vapor moving path 40. The flow path 14*t* is formed in contact with the partitioning wall 41 of the vapor moving path 40, for example. The flow path 14*t* is formed in contact with the porous body 30, for example. The flow path 14*t* is formed to extend in the longitudinal direction of the vapor moving path 40, for example. In other words, the flow path 14*t* is not communicated with the flow path 43 of the vapor moving path 40 and the flow path 14*t* is communicated with the flow path 14*r* of the porous body 30.

Figure 11:
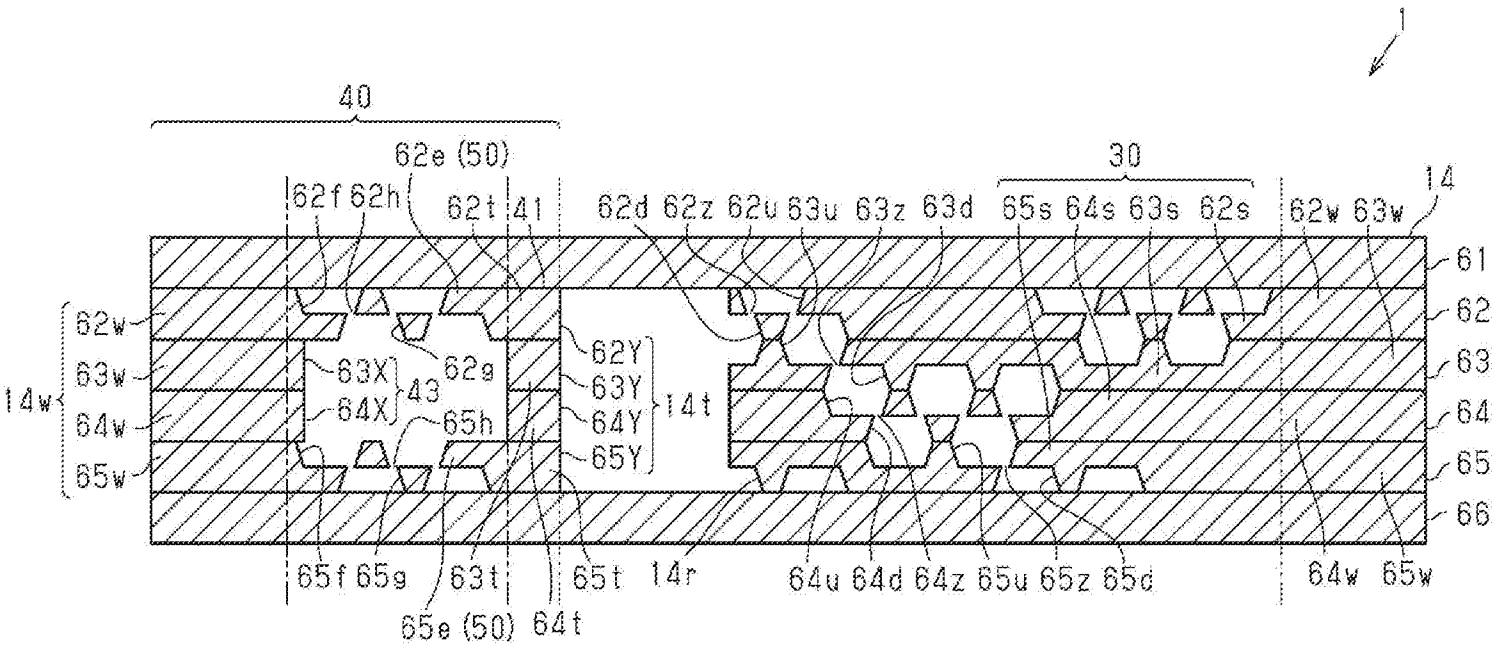
FIG. 11 is a schematic sectional view depicting a liquid pipe of the modified embodiment (a sectional view taken along a line 11A-11A in FIG. 10).

As shown in FIG. 11, the flow path 14*t* is configured by through-holes 62Y, 63Y, 64Y and 65Y penetrating the intermediate metal layers 62 to 65 of the stacked metal layers 61 to 66 in the thickness direction. The metal layers 62 to 65 are stacked so that the respective through-holes 62Y, 63Y, 64Y and 65Y overlap each other. The through-hole 62Y is formed to communicate with at least one (in FIG. 11, the bottomed hole 62*d*) of the bottomed holes 62*u* and 62*d* formed in the porous body 62*s* of the metal layer 62, for example. The through-hole 63Y is formed to communicate with at least one (in FIG. 11, the bottomed hole 63*u*) of the bottomed holes 63*u* and 63*d* formed in the porous body 63*s* of the metal layer 63, for example. The through-hole 64Y is formed to communicate with at least one (not shown in FIG. 11) of the bottomed holes 64*u* and 64*d* formed in the porous body 64*s* of the metal layer 64, for example. The through-hole 65Y is formed to communicate with at least one (in FIG. 11, the bottomed hole 65*d*) of the bottomed holes 65*u* and 65*d* formed in the porous body 65*s* of the metal layer 65, for example.

The flow path 14*t* as described above is provided, so that it is possible to increase an amount by which the operating fluid C condensed in the condenser 13 can be stored in the liquid pipe 14, as compared to a configuration in which the flow path 14*t* is not provided. Also, since the flow path 14*t* is provided adjacent to the vapor moving path 40, it is possible to increase an amount of the operating fluid C that can be warmed by the vapor Cv moving in the flow path 43 of the vapor moving path 40.

In the modified embodiment of FIG. 10, the flow path 14*t* is formed to extend from the evaporator 11 to a point on the halfway in the longitudinal direction of the liquid pipe 14. However, the present disclosure is not limited thereto. For example, the flow path 14*t* may be formed to extend over an entire length in the longitudinal direction of the liquid pipe 14.

The shapes of the bottomed holes shown in the above embodiment may be changed as appropriate.

In the above embodiment, a depth of the bottomed hole on the upper surface-side and a depth of the bottomed hole on the lower surface-side may be different from each other.

The porous bodies 20 and 30 and the porous part 50 of the above embodiment have the structure including the metal layers having first bottomed holes recessed from the upper surface-side, second bottomed holes recessed from the lower surface-side, and pores formed as the first bottomed holes and the second bottomed holes partially communicate with each other. However, the present disclosure is not limited thereto. For example, the porous bodies 20 and 30 and the porous part 50 may have such a configuration that a first metal layer having first through-holes penetrating in the thickness direction and a second metal layer having second through-holes penetrating in the thickness direction are provided and the first metal layer and the second metal layer are stacked so that the first through-holes and the second through-holes partially overlap each other. In this case, pores communicating with each other in portions in which the first through-holes and the second through-holes partially overlap are formed.

In the above embodiment, the formation position of the vapor moving path 40 is not particularly limited. That is, the formation position of the vapor moving path 40 is not particularly limited inasmuch as the vapor moving path 40 is formed to extend from the evaporator 11 in the longitudinal direction of the liquid pipe 14.

Figure 12:
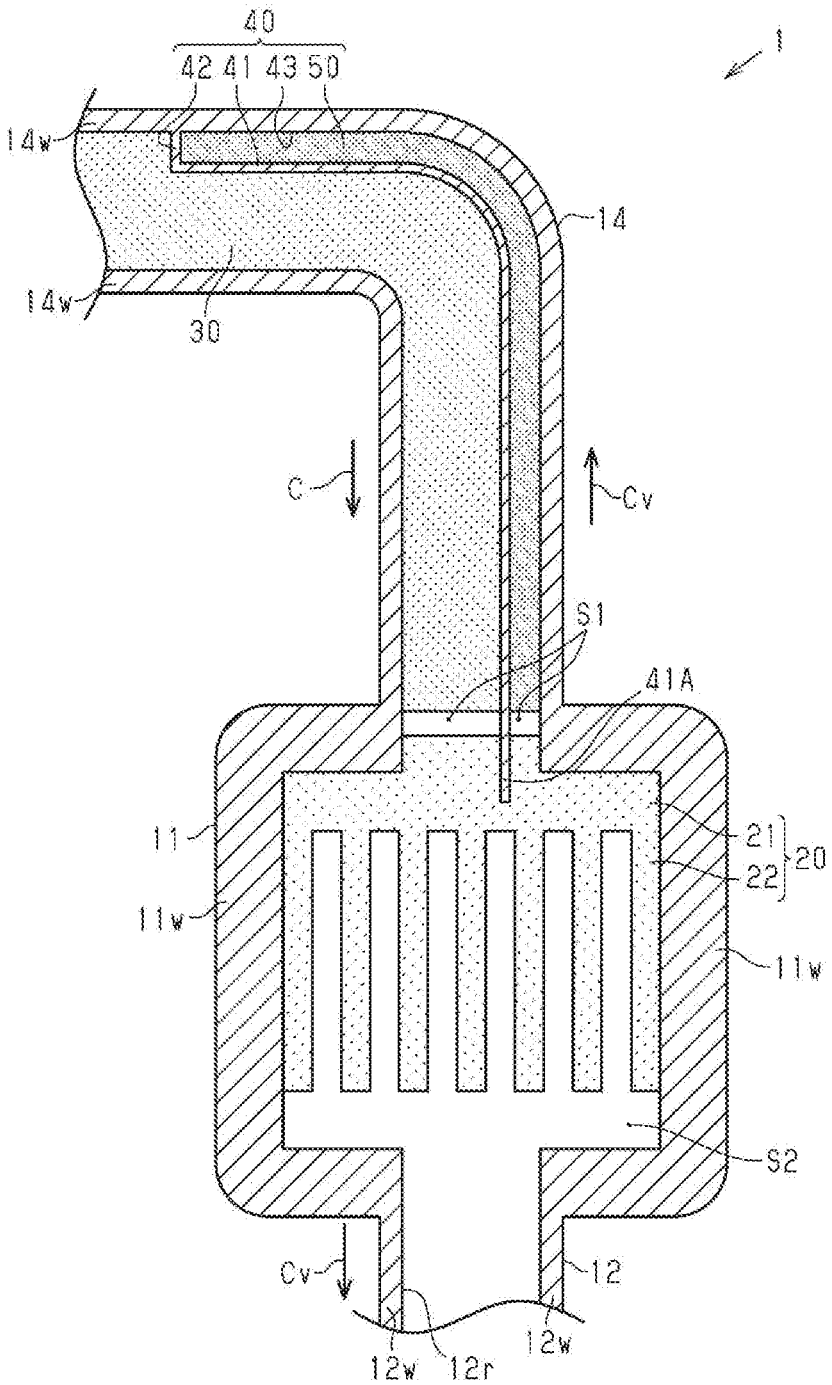
FIG. 12 is a schematic plan view depicting a loop-type heat pipe of a modified embodiment.

For example, as shown in FIG. 12, the vapor moving path 40 may be provided in the vicinity of the pipe wall 14*w*, which configures an outer side of the bent part of the liquid pipe 14, of the pair of pipe walls 14*w*. In the meantime, when the pipe wall 14*w* configuring the outer side of the bent part of the liquid pipe 14 is provided with the inlet for the operating fluid C, the vapor moving path 40 is formed so as not to overlap the inlet.

Also, the vapor moving path 40 may be provided in a central part of the liquid pipe 14 in the width direction.

The liquid pipe 14 of the above embodiment may be provided with a plurality of vapor moving paths 40.

What is claimed is:

1. A loop-type heat pipe comprising:

an evaporator configured to vaporize an operating fluid;

a condenser configured to condense the operating fluid;

a liquid pipe configured to connect the evaporator and the condenser;

a vapor pipe configured to connect the evaporator and the condenser;

a porous body provided in the liquid pipe; and a vapor moving path provided at a part in the liquid pipe separately from the porous body and extending from the evaporator along a longitudinal direction of the liquid pipe, the operating fluid vaporized in the evaporator moving in the vapor moving path, wherein the vapor moving path has a flow path in which the operating fluid vaporized in the evaporator flows and a wall part surrounding the flow path, the wall part having a partitioning wall that partitions the flow path from the porous body, the partitioning wall being formed to protrude into an internal space of the evaporator.

2. The loop-type heat pipe according to claim 1, wherein the vapor moving path has a porous part formed in contact with the flow path.

3. The loop-type heat pipe according to claim 2, wherein the porous part is formed in a portion other than the partitioning wall of the wall part.

4. The loop-type heat pipe according to claim 2, wherein the porous part comprises a metal layer having first bottomed holes recessed from one surface, second bottomed holes recessed from the other surface, and pores formed as the first bottomed holes and the second bottomed holes partially communicate with each other.

5. The loop-type heat pipe according to claim 2, wherein a cross-sectional area of the flow path of the vapor moving path is formed greater than a cross-sectional area of a flow path of the porous body and smaller than a cross-sectional area of a flow path of the vapor pipe.

6. The loop-type heat pipe according to claim 1, wherein the vapor moving path has a groove portion formed in the wall part so as to be in contact with the flow path.

7. The loop-type heat pipe according to claim 1, wherein the vapor moving path is formed to extend from the evaporator to a point on the halfway in the longitudinal direction of the liquid pipe, and an end portion of the vapor moving path at a part on the halfway is blocked.

8. The loop-type heat pipe according to claim 1, wherein the liquid pipe has a flow path in which the operating fluid condensed in the condenser flows, and the flow path of the liquid pipe is provided between the vapor moving path and the porous body, and adjacent to the vapor moving path.

9. The loop-type heat pipe according to claim 1, wherein the wall part has a pipe wall of the liquid pipe.

10. The loop-type heat pipe according to claim 1, wherein a cross-sectional area of the flow path of the vapor moving path is formed greater than a cross-sectional area of a flow path of the porous body and smaller than a cross-sectional area of a flow path of the vapor pipe.

11. The loop-type heat pipe according to claim 1, wherein the flow path and the porous body are incommunicably separated by the partitioning wall.

* * * * *